United States Patent [19]

Herbig

[11] 4,166,329

[45] Sep. 4, 1979

[54] ADJUSTABLE ARCH SUPPORT FOR SHOES

[76] Inventor: Charles A. Herbig, 680 Jackson St., Lot 16, Hillsdale, Ill. 61257

[21] Appl. No.: 949,994

[22] Filed: Oct. 10, 1978

[51] Int. Cl.[2] ..... A43B 3/26

[52] U.S. Cl. ..... 36/97

[58] Field of Search ..... 36/91, 97, 119, 25 R

[56] References Cited

U.S. PATENT DOCUMENTS

| | | | |
|---|---|---|---|
| 1,633,413 | 6/1927 | Marca | 36/97 |
| 3,828,448 | 8/1974 | Leonildo | 36/119 |
| 4,060,918 | 12/1977 | Mandel | 36/97 |

*Primary Examiner*—Patrick D. Lawson

*Attorney, Agent, or Firm*—Glenn H. Antrim

[57] ABSTRACT

The height of the arch of an arch-support member is adjustable by turning a screw that is positioned between the insole and the sole of a shoe. A lever extends from the central portion of the arch support downwardly through the insole to the adjusting screw. The lever turns about the insole as a fulcrum in response to adjustment of the screw for varying the height of the arch-support member.

2 Claims, 3 Drawing Figures

ADJUSTABLE ARCH SUPPORT FOR SHOES

BACKGROUND OF THE INVENTION

This invention relates to shoes having devices for correcting foot deformities and particularly to adjustable arch supports as parts of shoes.

Arch supports for many users must be changed frequently to provide optimum heights for the users. Usually, different arch supports or adjustments by specialists are required for gradually correcting deformities of the users' feet. The required adjustments in heights of arch supports are expensive and time-consuming for the users.

SUMMARY OF THE INVENTION

An arch support within a shoe is continuously adjustable in height by a lever below the center of the arch of the arch support. The lever has an upper end contacting the lower surface of the arch and is adjustable to change its inclination for varying the height of the arch support, the greatest variation generally being along that portion of the arch that contacts the inner portion of the foot of the user.

The adjustable lever is inclined downwardly from the inner central portion of the arch through an aperture of an insole below the arch support. The lower end of the lever at a short distance below the insole has a hole for receiving a screw that functions as an actuator. A head of the screw for receiving an adjusting tool such as a screw driver or a hex key is positioned between the edges of a sole and the insole of the shoe. The shank of the screw passes through the hole through the lower end of the lever, and a collar is fixed to the screw adjacent the side of the lever away from the head of the screw.

The remainder of the screw is threaded and extends through a mating internally threaded member that is fixed to the shoe. As the screw is turned in the direction to move the fixed collar against the lower end of the lever, the screw rotates the lever about the point where it passes through the insole. The resulting movement of the upper end of the lever inwardly against the gradual lower surface of the arch-support member raises the arch support for the user, and rotation of the screw in the opposite direction permits the arch support to be pressed downwardly to a lower position.

DESCRIPTION OF THE PREFERRED EMBODIMENT

Figure 1:
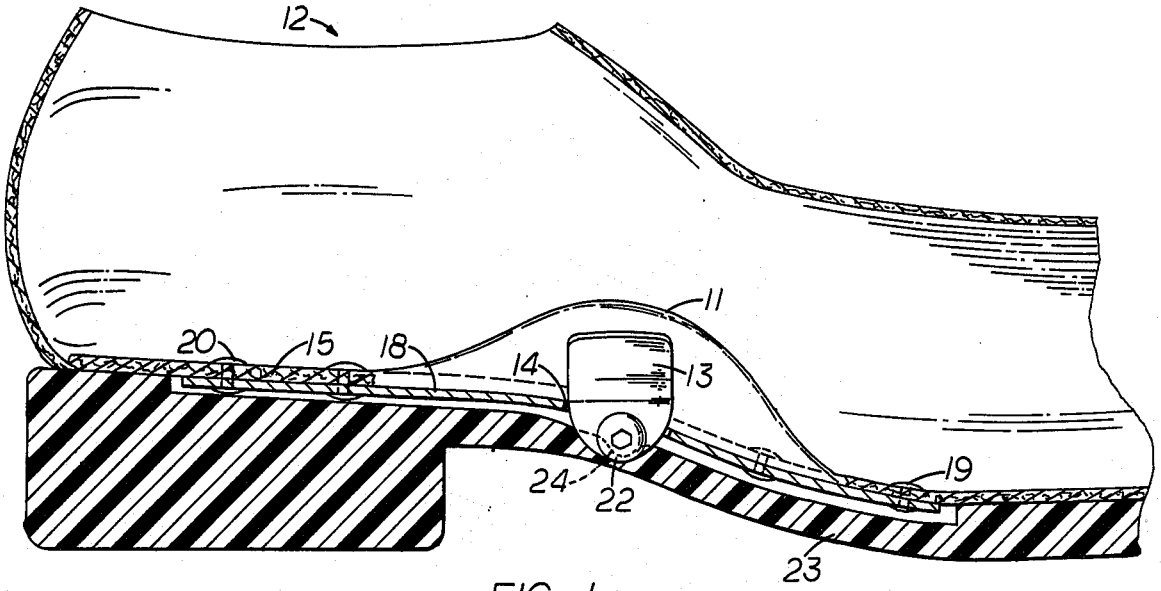
FIG. 1 is a cross-sectional view of a shoe as viewed from its inner side to show the adjustable arch support of this invention.
Figure 2:
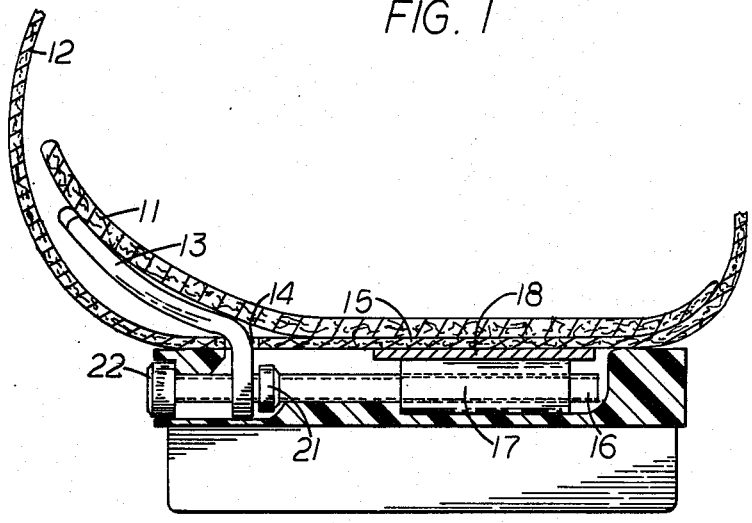
FIG. 2 is a lateral cross-sectional view of the shoe of FIG. 1 taken in front of the heel of the shoe as viewed from the toe of the shoe.
Figure 3:
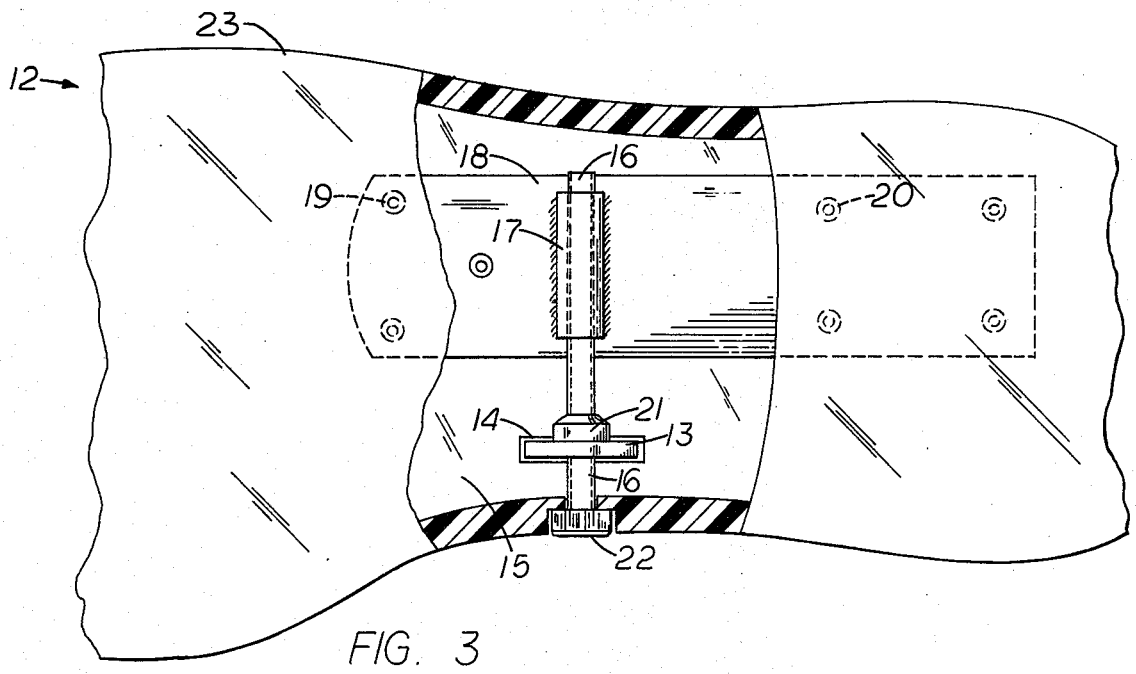
FIG. 3 is a bottom view of the shoe with a portion in front of a heel cut away to show a screw for adjusting the arch support.

With reference to FIGS. 1 and 2, an arch support 11 of usual shape is inserted over an insole of a shoe 12. The arch support 11 has a stiff, formed portion to fit in the arch of the foot of a user and preferably has leather or other smooth, soft material extending forward from the formed portion to the toe of the shoe and rearwardly to cover the insole of the shoe over the heel. In order to adjust the height of the arch support 11 as required for a user, an adjusting lever 13, that may be fabricated from a flat metal bar, has an upper end in contact with the formed, highest portion of the arch support 11 and a lower end that extends downwardly through an aperture 14 of an insole 15 to terminate a short distance below the insole at the sole 23 or in a shallow cavity 24 (FIG. 1) within the upper surface of the sole.

The height of the arch support 11 is varied by operation of an adjusting screw 16 that moves the lower end of the adjusting lever 13 in a lateral direction. The adjusting lever 13 is preferably bent downwardly where it passes through the aperture 14 of the insole 15 such that the lower part is substantially perpendicular to the insole 15 and the upper part slants outwardly and upwardly to contact the lower surface of the arch support 11. As the adjusting screw 16 is turned to move the lower end of the adjusting lever 13 outwardly, the portion of the adjusting lever 13 that passes through the aperture 14 bears against the edge of the insole 15 at the aperture 14 such that the line of contact between an adjusting lever and the insole functions as a fulcrum. Therefore, as the lower end of the adjusting lever 13 is moved outwardly, the upper end of the lever is moved inwardly against the upwardly curved portion of the arch support 11 to raise the arch support, particularly the highest portion that fits upwardly in the arch of a foot. The arch support has the usual shape, the outer edge fitting quite closely to the insole of the shoe along the length of the shoe and a gradually raised portion toward the inner side of the foot fitting in the arch.

In order to provide the desired movement of the adjusting lever 13, the adjusting screw 16 is turned into an inside-threaded sleeve 17. The sleeve 17 is fixed across an elongated plate 18 that extends forwardly a short distance toward the toe of the shoe and extends rearwardly over a portion of the heel of the shoe. The plate may be somewhat closer to the outer edge of a shoe than it is to the inner edge, and it is fastened to the insole 15 of the shoe by suitable fasteners 19 and 20. If desired, the fasteners 20 at the rear could extend downwardly into the heel of the shoe.

The end of the screw 16 toward the inside edge of the shoe 12 has either a slotted head or a socket for receiving a tool. The head 22 is between the sole 23 and the insole 15 and is preferably inside the edges of the soles. In the direction from the head 22, the screw 16 extends inwardly through a hole that has been provided through the lower end of the adjusting lever 13. At a point along the screw determined for having the lower end of the adjusting lever 13 nearly perpendicular for mid-range adjustment, a collar 21 is firmly fixed to the screw such that the collar bears against that surface of the lower end of the adjusting lever 13 away from the head of the screw. The end of the screw 16 opposite its head 22 is turned into the fixed sleeve 17.

I claim:

1. An adjustable arch support for a shoe comprising: an arch-support member having an outer edge conforming quite closely over an outer edge of an insole of said shoe and having an upper surface extending from said outer edge inwardly to an inner edge over an inner edge of said insole, said inner edge of said arch-support member curving gradually to form an arch to fit within the arch of a foot, said arch-support member being movable in height within said shoe according to the requirement for support by a user, said shoe having an insole with an aperture therethrough substantially directly below a central portion of said arch-support member, an adjusting lever having an upper end above said insole to contact a lower surface of said central portion of said arch of said arch-support member, said adjusting lever extending downwardly from said upper end through said aperture to a lower end terminating a short distance below said insole, a plate secured to said shoe to extend over an area below said arch-support member, and adjusting means connected between said plate and said lower end of said adjusting lever to move said lower end laterally, said adjusting lever being pivoted at said aperture to change the height of said arch-support member in response to operation of said adjusting means.

2. An adjustable arch support as claimed in claim 1 wherein said adjusting means comprises a screw and a sleeve, said screw having a portion contacting the lower end of said adjusting lever, said sleeve being attached to said plate and having an inside thread for receiving said screw, and said sleeve being oriented with respect to said insole for positioning said screw laterally in line with said lower end of said adjusting lever.

* * * * *